US010867578B2

(12) United States Patent
Chen et al.

(10) Patent No.: US 10,867,578 B2
(45) **Date of Patent: *Dec. 15, 2020**

(54) AMBIENT LIGHT ADAPTIVE DISPLAYS WITH PAPER-LIKE APPEARANCE

(71) Applicant: Apple Inc., Cupertino, CA (US)

(72) Inventors: Cheng Chen, San Jose, CA (US); Jiaying Wu, San Jose, CA (US); Will Riedel, San Francisco, CA (US); Wei Chen, Palo Alto, CA (US); John Z. Zhong, Saratoga, CA (US)

(73) Assignee: Apple Inc., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/194,084

(22) Filed: Nov. 16, 2018

(65) Prior Publication Data

US 2019/0139512 A1 May 9, 2019

Related U.S. Application Data

(63) Continuation of application No. 15/388,416, filed on Dec. 22, 2016, now Pat. No. 10,192,519, which is a (Continued)

(51) Int. Cl.

| | |
|---|---|
| ***G09G 5/02*** | (2006.01) |
| ***G09G 3/20*** | (2006.01) |
| ***G09G 3/34*** | (2006.01) |

(52) U.S. Cl.

CPC ..... *G09G 5/02* (2013.01); *G09G 3/2003* (2013.01); *G09G 3/3413* (2013.01); (Continued)

(58) Field of Classification Search

CPC ..... G09G 2360/144; G09G 2320/0666; G09G 2320/0626; H04N 5/58

See application file for complete search history.

(56) References Cited

U.S. PATENT DOCUMENTS

| | | |
|---|---|---|
| 5,710,876 A | 1/1998 | Peercy et al. |
| 5,726,672 A | 3/1998 | Hernandez et al. |

(Continued)

FOREIGN PATENT DOCUMENTS

| | | |
|---|---|---|
| CN | 101765878 | 6/2010 |
| CN | 201796510 | 4/2011 |

(Continued)

*Primary Examiner* — Koosha Sharifi-Tafreshi

(74) *Attorney, Agent, or Firm* — Treyz Law Group, P.C.; Kendall W. Abbasi

(57) ABSTRACT

An electronic device may include a display having an array of display pixels and having display control circuitry that controls the operation of the display. The display control circuitry may operate the display in different modes. In a paper mode, display control circuitry may use stored spectral reflectance data to adjust display colors such that the colors appear as they would on a printed sheet of paper. In a low light mode when the ambient light level is below a threshold, the light emitted from the display may be adjusted to mimic the appearance of an incandescent light source. In a bright light mode when the ambient light level exceeds a threshold, the light emitted from the display may be adjusted to maximize readability in bright light. The target white point of the display may be adjusted based on which mode the display is operating in.

20 Claims, 9 Drawing Sheets

Related U.S. Application Data continuation of application No. 14/673,667, filed on Mar. 30, 2015, now Pat. No. 9,530,362.

(60) Provisional application No. 62/096,188, filed on Dec. 23, 2014.

(52) U.S. Cl.
CPC ..... *G09G 2320/0242* (2013.01); *G09G 2320/066* (2013.01); *G09G 2320/0626* (2013.01); *G09G 2320/0666* (2013.01); *G09G 2320/08* (2013.01); *G09G 2360/144* (2013.01)

(56) References Cited

U.S. PATENT DOCUMENTS

| | | | | |
|---|---|---|---|---|
| 5,952,992 | A | 9/1999 | Helms | |
| 6,459,436 | B1 | 10/2002 | Kumada et al. | |
| 6,480,202 | B1 | 11/2002 | Deguchi et al. | |
| 6,611,297 | B1 | 8/2003 | Akashi et al. | |
| 6,628,822 | B1 | 9/2003 | Nakabayashi et al. | |
| 6,870,567 | B2 | 3/2005 | Funston et al. | |
| 6,947,017 | B1 | 9/2005 | Gettemy | |
| 6,952,195 | B2 | 10/2005 | Arakawa | |
| 7,142,218 | B2 | 11/2006 | Yoshida et al. | |
| 7,468,722 | B2 | 12/2008 | Ferguson | |
| 7,969,478 | B1 | 6/2011 | Chen et al. | |
| 7,973,779 | B2 | 7/2011 | Masalkar et al. | |
| 8,274,718 | B2 | 9/2012 | Kawai et al. | |
| 8,350,787 | B2 | 1/2013 | Tanba et al. | |
| 8,520,022 | B1 | 8/2013 | Cohen et al. | |
| 8,848,003 | B2 | 9/2014 | Takahashi et al. | |
| 9,965,999 | B1 * | 5/2018 | Barnes | G09G 3/32 |
| 2001/0040588 | A1 | 11/2001 | Shiraiwa et al. | |
| 2001/0050757 | A1 | 12/2001 | Yoshida et al. | |
| 2002/0080245 | A1 | 6/2002 | Parulski et al. | |
| 2002/0118294 | A1 | 8/2002 | Takano et al. | |
| 2002/0158812 | A1 | 10/2002 | Pallakoff | |
| 2004/0070565 | A1 | 4/2004 | Nayar et al. | |
| 2005/0280869 | A1 | 12/2005 | Kameyama | |
| 2006/0007223 | A1 | 1/2006 | Parker | |
| 2006/0109218 | A1 | 5/2006 | Kim et al. | |
| 2007/0097333 | A1 | 5/2007 | Zavarehi et al. | |
| 2007/0126727 | A1 | 6/2007 | Chiang | |
| 2008/0142687 | A1 | 6/2008 | Zhou et al. | |
| 2008/0165203 | A1 | 7/2008 | Panffoerder | |
| 2008/0180426 | A1 | 7/2008 | Liu et al. | |
| 2008/0204384 | A1 * | 8/2008 | Lee | G09G 3/3233 345/83 |
| 2008/0279451 | A1 | 11/2008 | Shimbaru | |
| 2008/0303918 | A1 * | 12/2008 | Keithley | G09G 3/20 348/223.1 |
| 2009/0040205 | A1 | 2/2009 | Scheibe | |
| 2009/0096745 | A1 | 4/2009 | Sprague et al. | |
| 2009/0109129 | A1 | 4/2009 | Cheong et al. | |
| 2009/0153888 | A1 | 6/2009 | Edge | |
| 2009/0167950 | A1 | 7/2009 | Chen et al. | |
| 2009/0195670 | A1 | 8/2009 | Koishi | |
| 2009/0201309 | A1 | 8/2009 | Demos | |
| 2010/0060674 | A1 | 3/2010 | Yoshida et al. | |
| 2010/0060911 | A1 | 3/2010 | Marcu et al. | |
| 2010/0194289 | A1 | 8/2010 | Katayanagi et al. | |
| 2010/0320919 | A1 | 12/2010 | Gough et al. | |
| 2011/0206348 | A1 | 8/2011 | Numakami | |
| 2011/0249141 | A1 * | 10/2011 | Chen | H04N 5/58 348/223.1 |
| 2012/0019493 | A1 | 1/2012 | Barnhoefer et al. | |
| 2012/0050307 | A1 * | 3/2012 | Mahowald | H05B 37/0218 345/590 |
| 2012/0081279 | A1 | 4/2012 | Greenebaum et al. | |
| 2012/0081663 | A1 | 4/2012 | Schmid | |
| 2012/0182276 | A1 | 7/2012 | Kee | |
| 2012/0182278 | A1 | 7/2012 | Ballestad | |
| 2012/0268437 | A1 | 10/2012 | Lee | |
| 2012/0287605 | A1 | 11/2012 | Chen et al. | |
| 2013/0093783 | A1 | 4/2013 | Sullivan et al. | |
| 2013/0328842 | A1 * | 12/2013 | Barnhoefer | G09G 3/3406 345/207 |
| 2014/0002428 | A1 | 1/2014 | Letourneur et al. | |
| 2014/0028197 | A1 | 1/2014 | van de Ven | |
| 2014/0055481 | A1 | 2/2014 | Gao | |
| 2014/0063039 | A1 * | 3/2014 | Drzaic | G09G 5/02 345/589 |
| 2014/0071102 | A1 | 3/2014 | Pieper et al. | |
| 2014/0152703 | A1 | 6/2014 | Yang et al. | |
| 2014/0285477 | A1 * | 9/2014 | Cho | G09G 3/2003 345/207 |
| 2014/0307007 | A1 | 10/2014 | Cho et al. | |
| 2014/0368483 | A1 | 12/2014 | Zhang et al. | |
| 2015/0070337 | A1 * | 3/2015 | Bell | G09G 3/2003 345/207 |
| 2015/0070402 | A1 | 3/2015 | Shah et al. | |
| 2015/0348502 | A1 | 12/2015 | Marcu et al. | |
| 2016/0140889 | A1 | 5/2016 | Wu et al. | |
| 2016/0180780 | A1 | 6/2016 | Chen et al. | |
| 2017/0011678 | A1 | 1/2017 | Cao et al. | |

FOREIGN PATENT DOCUMENTS

| | | | |
|---|---|---|---|
| CN | 201893105 | | 7/2011 |
| CN | 103634581 | | 3/2014 |
| CN | 103957345 | | 7/2014 |
| EP | 2172925 | | 4/2010 |
| EP | 2299723 | A1 | 3/2011 |
| EP | 2557557 | | 2/2013 |
| GB | 2341033 | | 3/2000 |
| JP | 09186896 | | 7/1997 |
| JP | H09098301 | | 8/1997 |
| JP | 11212056 | | 8/1999 |
| JP | 2002041017 | | 2/2002 |
| JP | 2002262119 | | 9/2002 |
| JP | 2002290979 | | 10/2002 |
| JP | 2002320233 | | 10/2002 |
| JP | 2002325260 | | 11/2002 |
| JP | 2003150099 | | 5/2003 |
| JP | 2004531716 | | 10/2004 |
| JP | 2008205542 | | 9/2008 |
| JP | 2008206067 | | 9/2008 |
| JP | 2009244340 | A | 10/2009 |
| JP | 2009267967 | | 11/2009 |
| JP | 2010-113301 | | 5/2010 |
| JP | 2010217133 | | 9/2010 |
| JP | 2010128218 | | 10/2010 |
| JP | 2299723 | | 3/2011 |
| JP | 2011205275 | | 10/2011 |
| JP | 2012027104 | | 2/2012 |
| KR | 1020070014813 | | 2/2007 |
| KR | 20120119717 | | 10/2012 |
| KR | 1020140094561 | | 7/2014 |
| KR | 20140116607 | | 10/2014 |
| TW | 200826038 | | 6/2008 |
| WO | 2013058945 | | 4/2013 |
| WO | 2014068830 | | 5/2014 |
| WO | 2015038407 | | 3/2015 |

* cited by examiner

AMBIENT LIGHT ADAPTIVE DISPLAYS WITH PAPER-LIKE APPEARANCE

This application is a continuation of U.S. patent application Ser. No. 15/388,416, filed Dec. 22, 2016, which is a continuation of U.S. patent application Ser. No. 14/673,667, filed Mar. 30, 2015, now U.S. Pat. No. 9,530,362, which claims priority to U.S. provisional patent application No. 62/096,188, filed Dec. 23, 2014, all of which are hereby incorporated by reference herein in their entireties.

BACKGROUND

This relates generally to electronic devices with displays and, more particularly, to electronic devices with displays that adapt to different ambient lighting conditions.

The chromatic adaptation function of the human visual system allows humans to generally maintain constant perceived color under different ambient lighting conditions. For example, white paper will appear white to the human eye even when illuminated under different ambient lighting conditions.

Conventional displays do not typically account for different ambient lighting conditions or the chromatic adaptation of the human visual system. As a result, a user may perceive undesirable color shifts in the display under different ambient lighting conditions. For example, the white point of a display may appear white to a user in outdoor ambient lighting conditions, but may appear bluish to the user in an indoor environment when the user's eyes have adapted to the warmer light produced by indoor light sources. Similarly, white light emitted from the display under a cool white light source may appear red to a viewer who has adapted to the cool white light.

It would therefore be desirable to be able to provide improved ways of displaying images with displays.

SUMMARY

An electronic device may include a display having an array of display pixels and having display control circuitry that controls the operation of the display. The display control circuitry may adaptively adjust the output from the display based on ambient lighting conditions.

The display control circuitry may operate the display in different modes depending on the ambient lighting conditions. For example, the electronic device may include a color-sensitive light sensor that measures the brightness and color of ambient light. Display control circuitry may determine which mode to operate the display in based on the ambient light sensor data.

In a paper mode, display control circuitry may use stored spectral reflectance data (e.g., spectral reflectance data that describes the reflectance spectra of colors printed on paper) to adjust display colors such that the colors appear as they would on a printed sheet of paper. This may include, for example, adjusting pixel data based on the spectral reflectance data associated with the color to be produced as well as the color and intensity of ambient light measured by the color-sensitive light sensor. The adjusted pixel data may be provided to the pixel array to produce the desired color.

In a low light mode when the ambient light level is below a threshold, the light emitted from the display may be adjusted to mimic the appearance of an incandescent light source. In a bright light mode when the ambient light level exceeds a threshold, the light emitted from the display may be adjusted to maximize readability in bright light. The target white point of the display may be selected depending on which mode the display is operating in. In low light mode, for example, the target white point may be shifted towards the yellow portion of the spectrum to produce warm white light, which may in turn have beneficial effects on the human circadian rhythm by displaying warmer colors in the evening.

Further features of the invention, its nature and various advantages will be more apparent from the accompanying drawings and the following detailed description of the preferred embodiments.

DETAILED DESCRIPTION

Electronic devices such as cellular telephones, media players, computers, set-top boxes, wireless access points, and other electronic equipment may include displays. Displays may be used to present visual information and status data and/or may be used to gather user input data.

Figure 1:
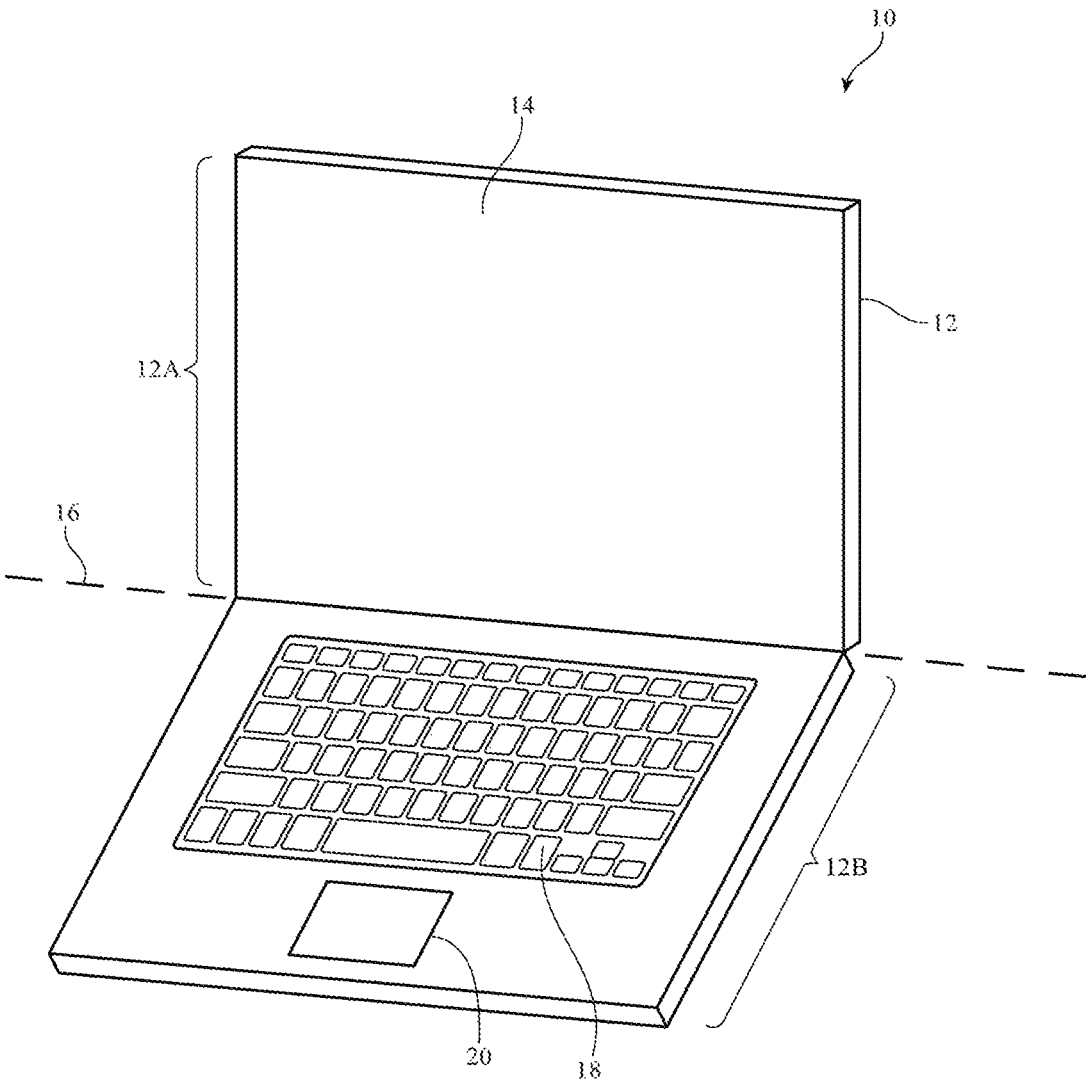
FIG. 1 is a perspective view of an illustrative electronic device such as a portable computer having an ambient light adaptive display in accordance with an embodiment of the present invention.

An illustrative electronic device of the type that may be provided with an ambient light adaptive display is shown in FIG. 1. Electronic device 10 may be a computer such as a computer that is integrated into a display such as a computer monitor, a laptop computer, a tablet computer, a somewhat smaller portable device such as a wrist-watch device, pendant device, or other wearable or miniature device, a cellular telephone, a media player, a tablet computer, a gaming device, a navigation device, a computer monitor, a television, or other electronic equipment.

As shown in FIG. 1, device 10 may include a display such as display 14. Display 14 may be a touch screen that incorporates capacitive touch electrodes or other touch sensor components or may be a display that is not touch-sensitive. Display 14 may include image pixels formed from light-emitting diodes (LEDs), organic light-emitting diodes (OLEDs), plasma cells, electrophoretic display elements, electrowetting display elements, liquid crystal display (LCD) components, or other suitable image pixel structures. Arrangements in which display 14 is formed using organic light-emitting diode pixels are sometimes described herein as an example. This is, however, merely illustrative. Any suitable type of display technology may be used in forming display 14 if desired.

Device 10 may have a housing such as housing 12. Housing 12, which may sometimes be referred to as a case, may be formed of plastic, glass, ceramics, fiber composites, metal (e.g., stainless steel, aluminum, etc.), other suitable materials, or a combination of any two or more of these materials.

Housing 12 may be formed using a unibody configuration in which some or all of housing 12 is machined or molded as a single structure or may be formed using multiple structures (e.g., an internal frame structure, one or more structures that form exterior housing surfaces, etc.).

As shown in FIG. 1, housing 12 may have multiple parts. For example, housing 12 may have upper portion 12A and lower portion 12B. Upper portion 12A may be coupled to lower portion 12B using a hinge that allows portion 12A to rotate about rotational axis 16 relative to portion 12B. A keyboard such as keyboard 18 and a touch pad such as touch pad 20 may be mounted in housing portion 12B.

Figure 2:
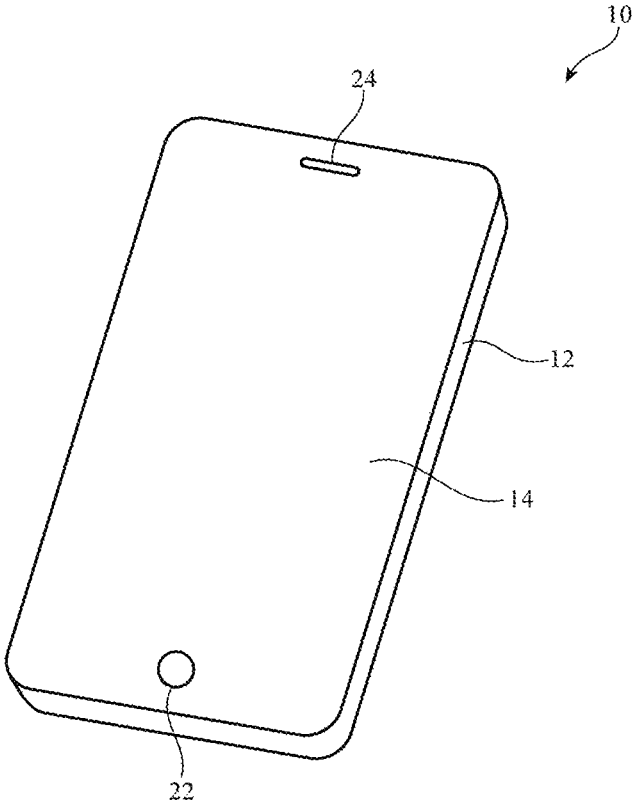
FIG. 2 is a perspective view of an illustrative electronic device such as a cellular telephone or other handheld device having an ambient light adaptive display in accordance with an embodiment of the present invention.

In the example of FIG. 2, device 10 has been implemented using a housing that is sufficiently small to fit within a user's hand (e.g., device 10 of FIG. 2 may be a handheld electronic device such as a cellular telephone). As show in FIG. 2, device 10 may include a display such as display 14 mounted on the front of housing 12. Display 14 may be substantially filled with active display pixels or may have an active portion and an inactive portion. Display 14 may have openings (e.g., openings in the inactive or active portions of display 14) such as an opening to accommodate button 22 and an opening to accommodate speaker port 24.

Figure 3:
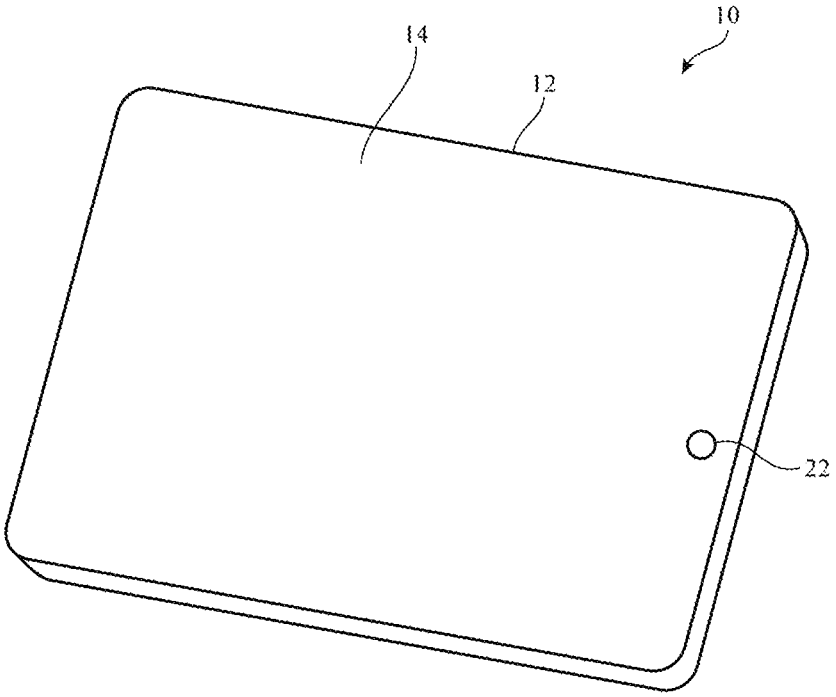
FIG. 3 is a perspective view of an illustrative electronic device such as a tablet computer having an ambient light adaptive display in accordance with an embodiment of the present invention.

FIG. 3 is a perspective view of electronic device 10 in a configuration in which electronic device 10 has been implemented in the form of a tablet computer. As shown in FIG. 3, display 14 may be mounted on the upper (front) surface of housing 12. An opening may be formed in display 14 to accommodate button 22.

Figure 4:
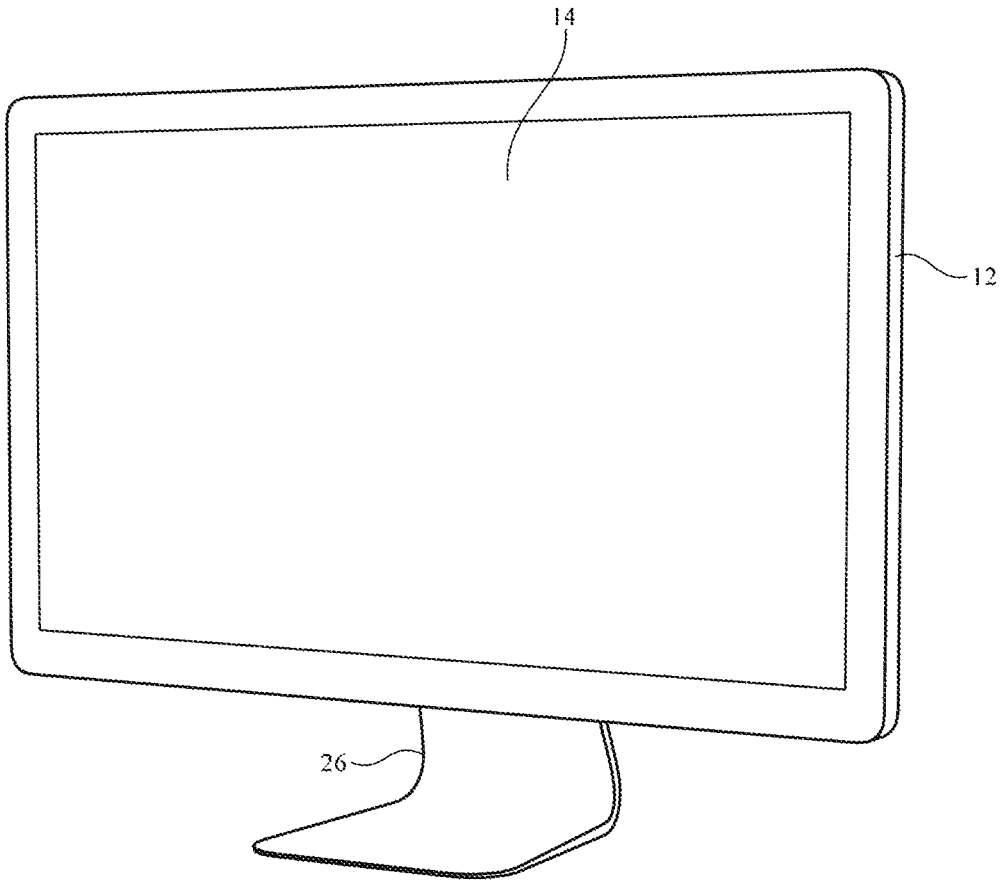
FIG. 4 is a perspective view of an illustrative electronic device such as a computer monitor with a built-in computer having an ambient light adaptive display in accordance with an embodiment of the present invention.

FIG. 4 is a perspective view of electronic device 10 in a configuration in which electronic device 10 has been implemented in the form of a computer integrated into a computer monitor. As shown in FIG. 4, display 14 may be mounted on a front surface of housing 12. Stand 26 may be used to support housing 12.

Figure 5:
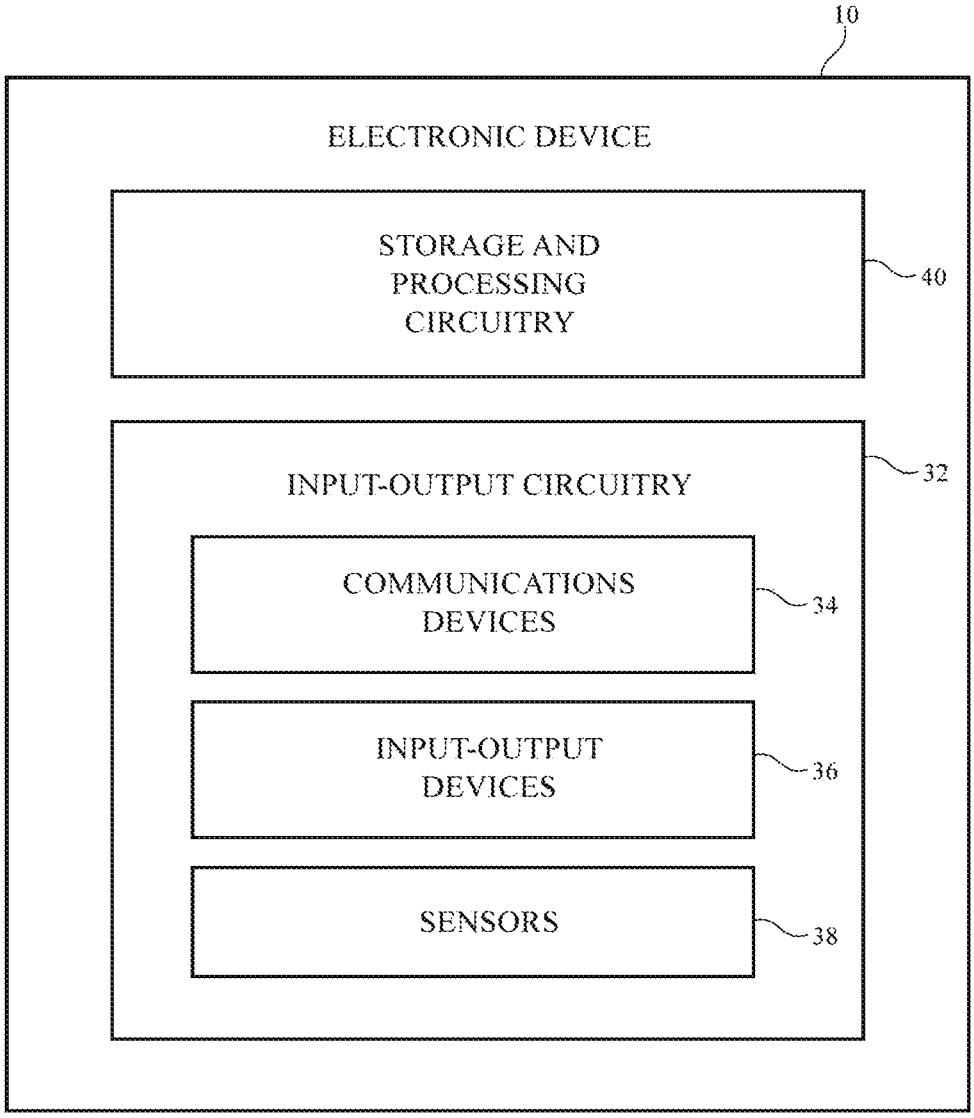
FIG. 5 is a schematic diagram of an illustrative system including an electronic device of the type that may be provided with an ambient light adaptive display in accordance with an embodiment of the present invention.

A schematic diagram of device 10 is shown in FIG. 5. As shown in FIG. 5, electronic device 10 may include control circuitry such as storage and processing circuitry 40. Storage and processing circuitry 40 may include one or more different types of storage such as hard disk drive storage, nonvolatile memory (e.g., flash memory or other electrically-programmable-read-only memory), volatile memory (e.g., static or dynamic random-access-memory), etc. Processing circuitry in storage and processing circuitry 40 may be used in controlling the operation of device 10. The processing circuitry may be based on one or more microprocessors, microcontrollers, digital signal processors, baseband processor integrated circuits, application specific integrated circuits, etc.

With one suitable arrangement, storage and processing circuitry 40 may be used to run software on device 10 such as internet browsing applications, email applications, media playback applications, operating system functions, software for capturing and processing images, software implementing functions associated with gathering and processing sensor data, software that makes adjustments to display brightness and touch sensor functionality, etc.

To support interactions with external equipment, storage and processing circuitry 40 may be used in implementing communications protocols. Communications protocols that may be implemented using storage and processing circuitry 40 include internet protocols, wireless local area network protocols (e.g., IEEE 802.11 protocols—sometimes referred to as WiFi®), protocols for other short-range wireless communications links such as the Bluetooth® protocol, etc.

Input-output circuitry 32 may be used to allow input to be supplied to device 10 from a user or external devices and to allow output to be provided from device 10 to the user or external devices.

Input-output circuitry 32 may include wired and wireless communications circuitry 34. Communications circuitry 34 may include radio-frequency (RF) transceiver circuitry formed from one or more integrated circuits, power amplifier circuitry, low-noise input amplifiers, passive RF components, one or more antennas, and other circuitry for handling RF wireless signals. Wireless signals can also be sent using light (e.g., using infrared communications).

Input-output circuitry 32 may include input-output devices 36 such as button 22 of FIG. 2, joysticks, click wheels, scrolling wheels, a touch screen (e.g., display 14 of FIG. 1, 2, 3, or 4 may be a touch screen display), other touch sensors such as track pads or touch-sensor-based buttons, vibrators, audio components such as microphones and speakers, image capture devices such as a camera module having an image sensor and a corresponding lens system, keyboards, status-indicator lights, tone generators, key pads, and other equipment for gathering input from a user or other external source and/or generating output for a user or for external equipment.

Sensor circuitry such as sensors 38 of FIG. 5 may include an ambient light sensor for gathering information on ambient light, proximity sensor components (e.g., light-based proximity sensors and/or proximity sensors based on other structures), accelerometers, gyroscopes, magnetic sensors, and other sensor structures. Sensors 38 of FIG. 5 may, for example, include one or more microelectromechanical systems (MEMS) sensors (e.g., accelerometers, gyroscopes, microphones, force sensors, pressure sensors, capacitive sensors, or any other suitable type of sensor formed using a microelectromechanical systems device).

Figure 6:
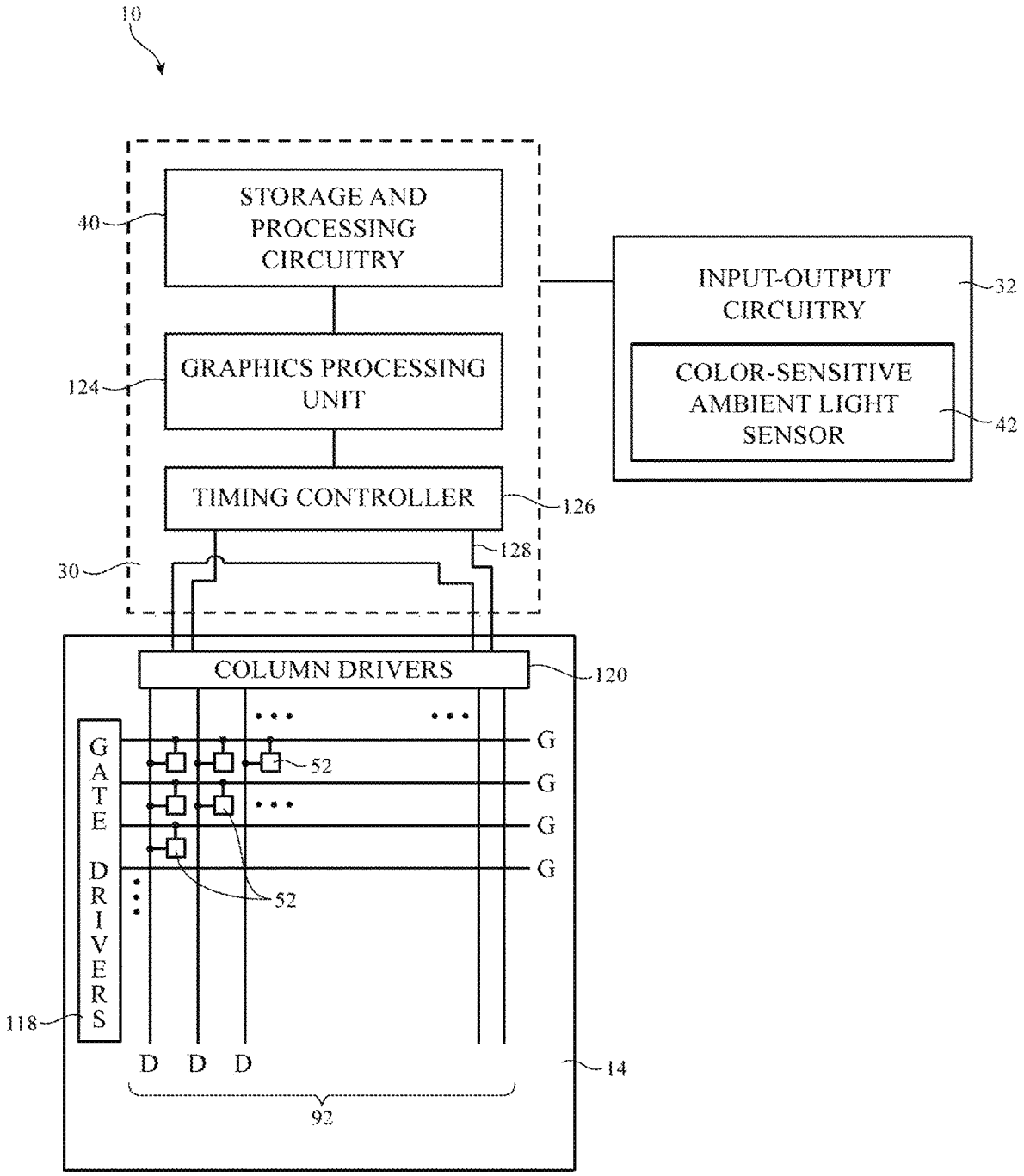
FIG. 6 is a schematic diagram of an illustrative electronic device having a display and display control circuitry in accordance with an embodiment of the present invention.

FIG. 6 is a diagram of device 10 showing illustrative circuitry that may be used in displaying images for a user of device 10 on pixel array 92 of display 14. As shown in FIG. 6, display 14 may have column driver circuitry 120 that drives data signals (analog voltages) onto the data lines D of array 92. Gate driver circuitry 118 drives gate line signals onto gate lines G of array 92. Using the data lines and gate lines, display pixels 52 may be configured to display images on display 14 for a user. Gate driver circuitry 118 may be implemented using thin-film transistor circuitry on a display substrate such as a glass or plastic display substrate or may be implemented using integrated circuits that are mounted on the display substrate or attached to the display substrate by a flexible printed circuit or other connecting layer. Column driver circuitry 120 may be implemented using one or more column driver integrated circuits that are mounted on the display substrate or using column driver circuits mounted on other substrates.

During operation of device 10, storage and processing circuitry 40 may produce data that is to be displayed on display 14. This display data may be provided to display control circuitry such as timing controller integrated circuit 126 using graphics processing unit 124.

Timing controller 126 may provide digital display data to column driver circuitry 120 using paths 128. Column driver circuitry 120 may receive the digital display data from timing controller 126. Using digital-to-analog converter circuitry within column driver circuitry 120, column driver circuitry 120 may provide corresponding analog output signals on the data lines D running along the columns of display pixels 52 of array 92.

Storage and processing circuitry 40, graphics processing unit 124, and timing controller 126 may sometimes collectively be referred to herein as display control circuitry 30. Display control circuitry 30 may be used in controlling the operation of display 14.

Each pixel 52 may, if desired, be a color pixel such as a red (R) pixel, a green (G) pixel, a blue (B) pixel, a white (W) pixel, or a pixel of another color. Color pixels may include color filter elements that transmit light of particular colors or color pixels may be formed from emissive elements that emit light of a given color.

Pixels 52 may include pixels of any suitable color. For example, pixels 52 may include a pattern of cyan, magenta, and yellow pixels, or may include any other suitable pattern of colors. Arrangements in which pixels 52 include a pattern of red, green, and blue pixels are sometimes described herein as an example.

Display control circuitry 30 and associated thin-film transistor circuitry associated with display 14 may be used to produce signals such as data signals and gate line signals for operating pixels 52 (e.g., turning pixels 52 on and off, adjusting the intensity of pixels 52, etc.). During operation, display control circuitry 30 may control the values of the data signals and gate signals to control the light intensity associated with each of the display pixels and to thereby display images on display 14.

Display control circuitry 30 may obtain red, green, and blue pixel values (sometimes referred to as RGB values or digital display control values) corresponding to the color to be displayed by a given pixel. The RGB values may be converted into analog display signals for controlling the brightness of each pixel. The RGB values (e.g., integers with values ranging from 0 to 255) may correspond to the desired pixel intensity of each pixel. For example, a digital display control value of 0 may result in an "off" pixel, whereas a digital display control value of 255 may result in a pixel operating at a maximum available power.

It should be appreciated that these are examples in which eight bits are dedicated to each color channel. Alternative embodiments may employ greater or fewer bits per color channel. For example, if desired, six bits may be dedicated to each color channel. With this type of configuration, RGB values may be a set of integers ranging from 0 to 64. Arrangements in which each color channel has eight bits dedicated to it are sometimes described herein as an example.

As shown in FIG. 6, display control circuitry 30 may gather information from input-output circuitry 32 to adaptively determine how to adjust display light based on ambient lighting conditions. For example, display control circuitry 30 may gather light information from one or more light sensors such as color-sensitive ambient light sensor 42 (e.g., an ambient light sensor, a light meter, a color meter, a color temperature meter, and/or other light sensor), time information from a clock, calendar, and/or other time source, location information from location detection circuitry (e.g., Global Positioning System receiver circuitry, IEEE 802.11 transceiver circuitry, or other location detection circuitry), user input information from a user input device such as a touchscreen (e.g., touchscreen display 14) or keyboard, etc. Display control circuitry 30 may adjust the display light emitted from display 14 based on information from input-output circuitry 32.

Light sensors such as color light sensors 42 and cameras may, if desired, be distributed at different locations on electronic device 10 to detect light from different directions. Other sensors such as an accelerometer and/or gyroscope may be used to determine how to weight the sensor data from the different light sensors. For example, if the gyroscope sensor data indicates that electronic device 10 is placed flat on a table with display 14 facing up, electronic device 10 may determine that light sensor data gathered by rear light sensors (e.g., on a back surface of electronic device 10) should not be used.

Display control circuitry 30 may be configured to adaptively adjust the output from display 14 based on ambient lighting conditions. In adjusting the output from display 14, display control circuitry 30 may take into account the chromatic adaptation function of the human visual system. This may include, for example, determining characteristics of the light that the user's eyes are exposed to.

Figure 7:
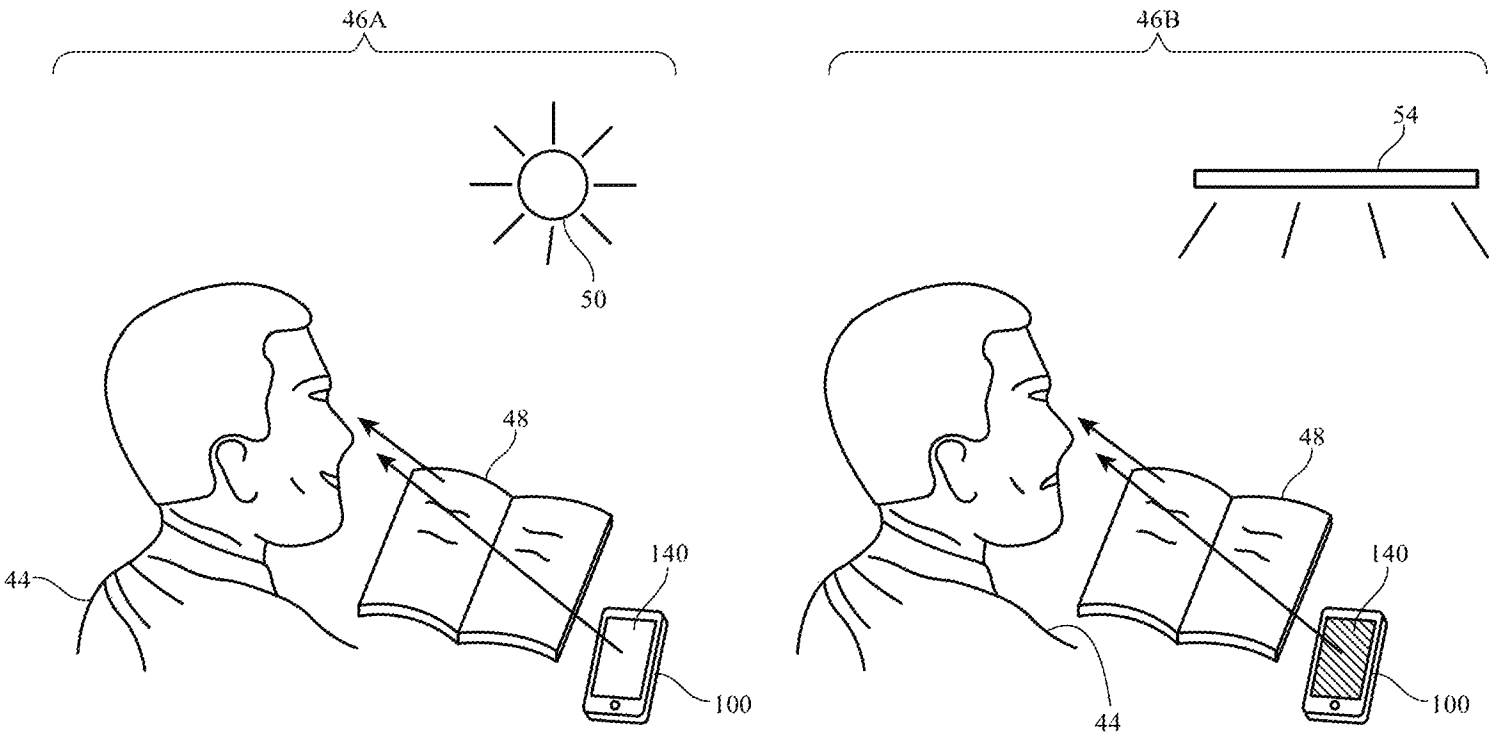
(PRIOR ART) FIG. 7
FIG. 7 is a diagram illustrating how a user may perceive undesirable color shifts when using a conventional display that does not account for the chromatic adaptation of the human visual system to different ambient lighting conditions.

FIG. 7 is a diagram illustrating the effects of using a conventional display that does not take into account the chromatic adaptation of human vision. In scenario 46A, user 44 observes external objects such as paper 48 under illuminant 50 (e.g., sunlight). The vision of user 44 adapts to the color and brightness of the ambient lighting conditions. Under illuminant 50, paper 48 appears white to user 44. Scenario 46B represents how a user perceives light reflected off of paper 48 and light from display 140 of device 100 after having adapted to the ambient lighting of illuminant 54 (e.g., a fluorescent light source emitting cool white light). Paper 48 still appears white to user 44, but because device 100 does not account for the chromatic adaptation of human vision, display 140 appears discolored (e.g., tinted red) and unsightly to user 44.

To avoid the perceived discoloration of display 14, display control circuitry 30 of FIG. 6 may adjust the output from display 14 based on ambient lighting conditions so that display 14 maintains a desired perceived appearance even as the user's vision adapts to different ambient lighting conditions.

Display control circuitry 30 may, if desired, adjust the color and brightness of light emitted from display 14 to mimic the appearance of a diffusely reflective object illuminated only by surrounding ambient light. In some scenarios, display 14 may be indistinguishable from a printed sheet of paper.

When viewing an object in ambient light, the spectrum of light that reaches one's eye is a function of the surrounding illuminants and the object's reflectivity spectrum. Thus, to mimic the appearance of a diffusely reflective object illuminated by ambient light, display control circuitry 30 may determine the brightness and color of ambient light using color-sensitive light sensor 42 (FIG. 6). Then, using known reflectivity behavior of the colors that the display is attempting to reproduce (e.g., known reflectivity data stored in device 10), display control circuitry 30 may adjust the color and brightness of display light such that the displayed images mimic the appearance of diffusely reflective objects.

In some ambient lighting conditions, it may not be desirable to mimic the appearance of a diffusely reflective object. For example, in low light levels where the display light is the main source of illumination around a user, it may be desirable to mimic the appearance of an indoor light source. In bright lighting conditions, it may be desirable to maximize readability.

To address these different scenarios, display control circuitry 30 may operate display 14 in different modes depending on the ambient lighting conditions. In a given display mode, display control circuitry 30 may adjust display light to achieve a given result.

Figure 8:
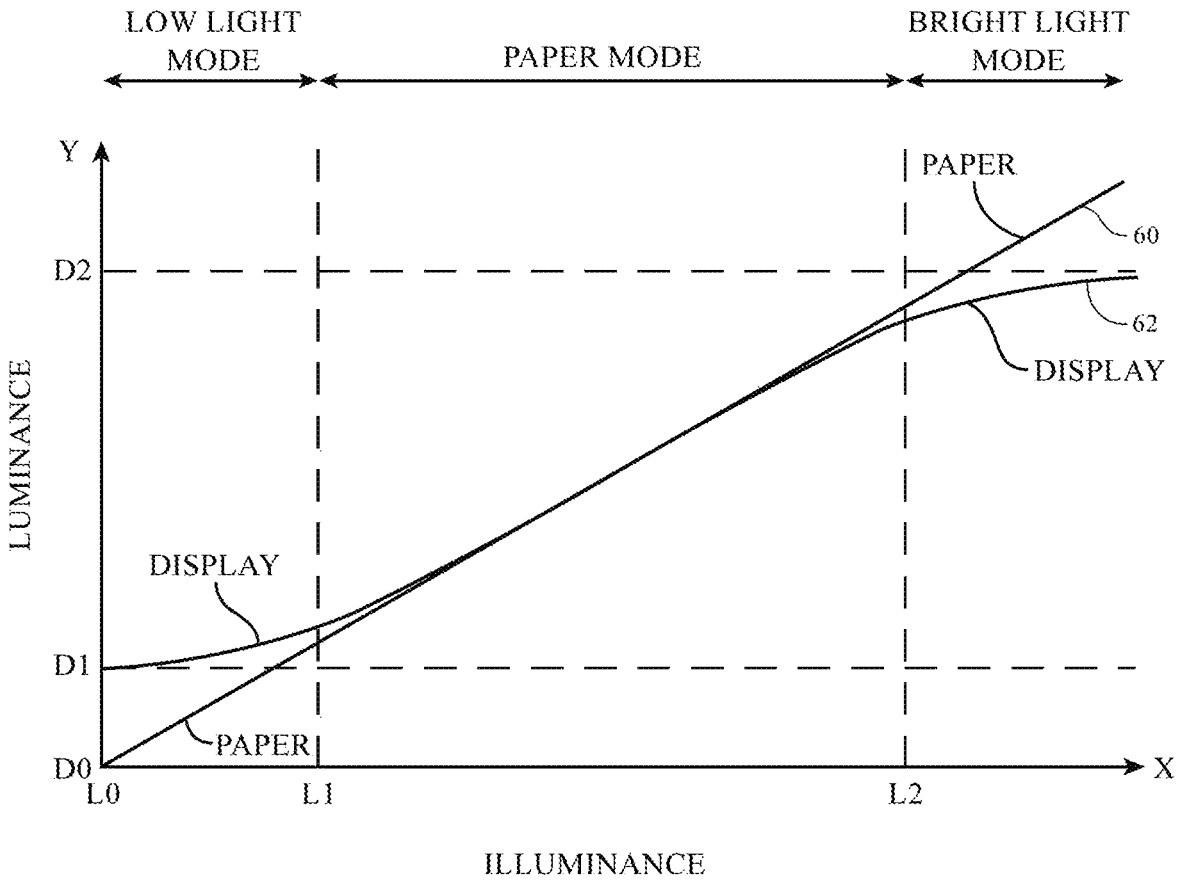
FIG. 8 is a diagram showing how a display may operate in different color adjusting modes based on ambient lighting conditions in accordance with an embodiment of the present invention.

FIG. 8 is a diagram illustrating how display 14 may be operated in different modes based on the ambient lighting conditions. The x-axis of FIG. 8 represents illuminance (e.g., the intensity of ambient light incident on an object such as display 14 or a piece of paper). The y-axis of FIG. 8 represents luminance. Curve 60 shows how the luminance of a diffusely reflective object such as paper changes as the intensity of the illuminant changes. Curve 62 shows how the luminance of display 14 may change as the intensity of the illuminant changes.

The intensity of ambient light incident on display 14 may be measured by a light sensor in electronic device 10 such as color-sensitive light sensor 42 of FIG. 6 or other suitable light sensor in device 10. Display control circuitry 30 may use light sensor information (e.g., ambient light intensity information) to determine what mode display 14 should be operated in. Display control circuitry 30 may then apply color and/or intensity adjustments to incoming display data based on the determined display mode.

In one suitable arrangement, which is sometimes described herein as an illustrative example, display control circuitry 30 may operate display 14 in a "low light mode" when light sensor 42 indicates ambient light levels are between L0 and L1, a "paper mode" when light sensor 42 indicates ambient light levels are between L1 and L2, and a "bright light mode" when light sensor 42 indicates ambient light levels are greater than L2.

L1 may be about 8.4 lux, about 8.5 lux, about 8.0 lux, greater than 8.0 lux, or less than 8.0 lux. L2 may be about 850 lux, about 900 lux, about 800 lux, greater than 800 lux, or less than 800 lux.

In paper mode, display control circuitry 30 may adjust display light such that the appearance of displayed images mimics that of a diffusely reflective object such as paper. This may include, for example, determining the brightness and color of ambient light using color-sensitive light sensor 42 and then using known reflectivity behavior of the colors that the display is attempting to reproduce to adjust the color and brightness of display light such that the displayed images mimic the appearance of diffusely reflective objects. As shown in FIG. 8, between ambient light levels L1 and L2, curve 62 corresponding to the luminance of display 14 closely matches curve 60 corresponding to the luminance of paper under the given illuminant.

For most ambient lighting conditions (e.g., between illuminance values L1 and L2), operating display 14 to mimic the appearance of printed paper may be the desirable mode of operation. In dim lighting conditions or very bright lighting conditions, however, it may be desirable to achieve other effects with display 14. To account for these different ambient lighting conditions, display control circuitry 30 may operate display 14 in low light mode when the ambient light levels are less than L1 and in bright light mode when ambient light levels are greater than L2.

In low light mode, it may not be desirable to mimic the appearance of printed paper because the ambient light may be too dim to sufficiently illuminate the displayed images. For example, when ambient light levels fall below L1, the luminance of paper may approach D0. If display 14 were also to approach D0 in dim ambient light, a user may find it difficult to read text or see images on display 14. Rather, since the light emitted from display 14 is the primary source of illumination in the vicinity of the user and there is no external source of illumination to adapt to, display control circuitry 30 may transition display 14 into self-illuminating low light mode (sometimes referred to as "lamp mode"). In low light mode, the white point of display 14 may be set to any desired white point, and display luminance levels may be kept at or above a desired minimum such as D1. D1 may, for example, be about 2.4 nits, about 2.5 nits, about 3.0 nits, greater than 3.0 nits, or less than 3.0 nits.

The white point of a display is commonly defined by a set of chromaticity coordinates that represent the color produced by the display when the display is generating all available display colors at full power. Prior to any corrections during calibration, the white point of the display may be referred to as the "native white point" of that display. Due to manufacturing differences between displays, the native white point of a display may differ, prior to calibration of the display, from the desired (target) white point of the display. The target white point may be defined by a set of chromaticity values associated with a reference white (e.g., a white produced by a standard display, a white associated with a standard illuminant such as the D65 illuminant of the International Commission on Illumination (CIE), a white produced at the center of a display). In general, any suitable white point may be used as a target white point for a display.

Using the display modes of FIG. 8, the target white point may, if desired, be dynamically adjusted during operation of display 14. For example, the chromaticity values associated with the target white point may shift depending on the color and brightness of ambient light. As such, the low light mode white point may be different than the paper mode white point and/or may be different than the bright light mode white point. The low light mode white point may be determined based on user preferences (e.g., may be set manually by the user) and/or may be determined based on other information.

If desired, the low light mode white point may be adjusted to achieve beneficial effects on the human circadian rhythm. The human circadian system may respond differently to different wavelengths of light. For example, when a user is exposed to blue light having a peak wavelength within a particular range, the user's circadian system may be activated and melatonin production may be suppressed. On the other hand, when a user is exposed to light outside of this range of wavelengths or when blue light is suppressed (e.g., compared to red light), the user's melatonin production may be increased, signaling nighttime to the body.

Conventional displays do not take into account the spectral sensitivity of the human circadian rhythm. For example, some displays emit light having spectral characteristics that trigger the circadian system regardless of the time of day, which can in turn have an adverse effect on sleep quality.

In contrast, by operating the display in low light mode when the ambient light falls below level L1 (e.g., at night when a user is indoors), the neutral point of display 14 may become warmer (e.g., may tend to the yellow portion of the spectrum) in dim ambient lighting conditions. Thus, when a user is at home in the evening (e.g., reading in warm ambient light), blue light emitted from display 14 may be suppressed as the display adapts to the ambient lighting conditions. The reduction in blue light may in turn reduce suppression of the user's melatonin production (or, in some scenarios, may increase the user's melatonin production) to promote better sleep.

This is, however, merely illustrative. In general, the white point of display 14 and the characteristics of neutral colors displayed by display 14 may be adjusted in any desirable fashion in low light mode. Since the ambient light from external light sources is not sufficiently bright to have a significant effect on the chromatic adaptation of the user's vision, the color and brightness of display 14 may be adjusted freely (e.g., based on user preferences, based on the time of day, etc.). As shown in FIG. 8, the luminance of display 14 in ambient light levels below L1 may be higher than the luminance of paper in ambient light levels below L1.

In bright ambient light (e.g., outdoors, in direct sunlight, etc.), it may also be desirable to change the mode of operation of display 14 from paper mode to a different mode of operation. For example, in ambient light levels above L2, the luminance of paper may exceed D2, but it may not be desirable or practical to exceed luminance D2 with display 14 to match the appearance of paper. Rather, display control circuitry 30 may operate display 14 to maximize readability by increasing brightness and contrast of displayed images. In some scenarios, this may include operating display 14 at luminance levels at or below D2 when ambient light levels exceed L2. D2 may be about 240 nits, about 250 nits, about 230 nits, less than 230 nits, or greater than 230 nits.

Figure 9:
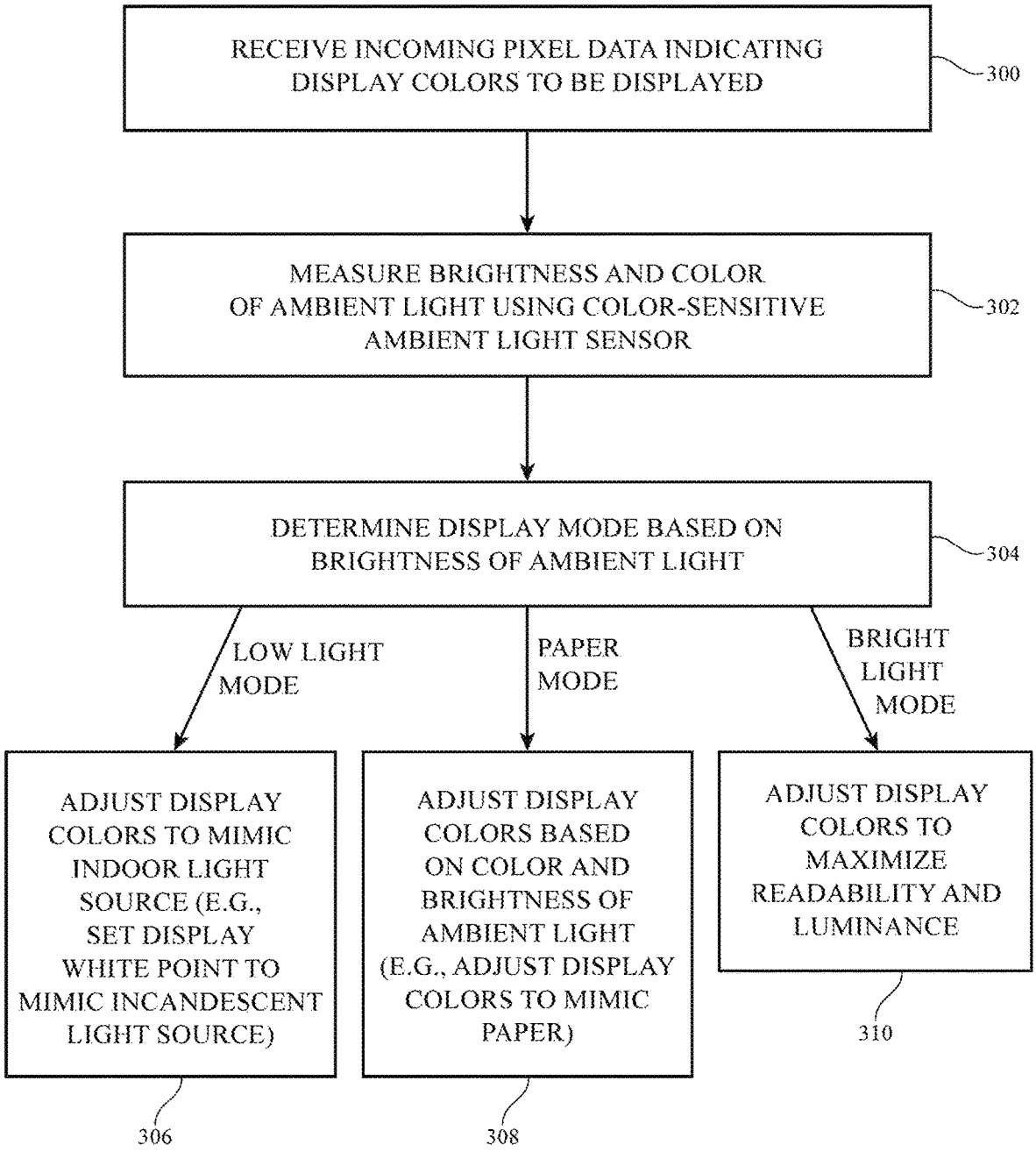
FIG. 9 is a flow chart of illustrative steps involved in operating a display that operates in different color adjusting modes based on ambient lighting conditions in accordance with an embodiment of the present invention.

FIG. 9 is a flow chart of illustrative steps involved in adjusting the output from display 14 based on ambient lighting conditions.

At step 300, display control circuitry 30 may receive incoming pixel values indicating display colors to be displayed by display 14. This may include, for example, receiving a frame of display data including red, green, and blue pixel values (sometimes referred to as RGB values or digital display control values) corresponding to the color to be displayed by a pixel in the frame of display data.

At step 302, display control circuitry 30 may gather light information from one or more light sensors such as color-sensitive light sensor 42 of FIG. 6 (e.g., an ambient light sensor, a light meter, a color meter, a color temperature meter, and/or other light sensor). This may include, for example, measuring the brightness and color characteristics of ambient light using light sensor 42.

At step 304, display control circuitry 30 may determine a display mode based on the brightness of the ambient light. When ambient light levels are below a threshold brightness (e.g., below illuminance value L1 of FIG. 8), display control circuitry 30 may set display 14 in low light mode and processing may proceed to step 306.

At step 306, display control circuitry 30 may operate display 14 in low light mode. In low light mode, the light emitted from display 14 is the primary source of illumination in the vicinity of the user and there is no external source of illumination to adapt to. Step 306 may include adjusting the chromaticity values associated with the target white point for display 14. In low light mode, the target white point of display 14 may be set to any desired white point, and display luminance levels may be kept at or above a desired minimum (e.g., above luminance value D1 of FIG. 8) to ensure readability even in the dim lighting conditions. The low light mode white point may be determined based on user preferences (e.g., may be set manually by the user) and/or may be determined based on other information.

If desired, the low light mode white point may be adjusted to achieve beneficial effects on the human circadian rhythm. This may include, for example, adjusting the neutral point of display 14 to be warmer (e.g., may tend to the yellow portion of the spectrum) in dim ambient lighting conditions. The neutral point in low light mode may be adjusted so that the light emitted from display 14 matches the color and brightness characteristics of a typical indoor light source (e.g., to mimic the appearance of an incandescent light bulb or other desired light source). Thus, when a user is at home in the evening (e.g., reading in warm ambient light), blue light emitted from display 14 may be suppressed as the display adapts to the ambient lighting conditions. The reduction in blue light may in turn reduce suppression of the user's melatonin production (or, in some scenarios, may increase the user's melatonin production) to promote better sleep.

This is, however, merely illustrative. In general, the white point of display 14 and the characteristics of neutral colors displayed by display 14 may be adjusted in any desirable fashion in low light mode. Since the ambient light from external light sources is not sufficiently bright to have a significant effect on the chromatic adaptation of the user's vision, the color and brightness of display 14 may be adjusted freely (e.g., based on user preferences, based on the time of day, etc.) to achieve the desired lighting effect.

If it is determined in step 304 that the ambient light level is within a given range of values (e.g., between illuminance values L1 and L2 of FIG. 8), display control circuitry 30 may set display 14 in paper mode and processing may proceed to step 308.

At step 308, display control circuitry 30 may adjust display light to mimic the appearance of printed paper. Since the way a user perceives a diffusely reflective object depends on the color and brightness of ambient light and the object's spectral reflectance, display control circuitry 30 may adjust display light based on the ambient light brightness and color information gathered in step 302 and based on the known reflectivity behavior of the colors that display 14 is intended to reproduce (e.g., based on the pixel data received in step 300 and based on stored spectral reflectance data).

Reflectivity information indicating reflectivity behavior of different colors may be stored in electronic device 10 (e.g., in storage and processing circuitry 40) and may be used to determine how display light should be adjusted in step 308. For example, light reflected off of a red image on a printed piece of paper may have first color characteristics under a first type of illuminant and second color characteristics under a second type of illuminant. Using this type of spectral reflectance information, display control circuitry 30 may determine how to adjust display colors to mimic that of a diffusely reflective object under a given illuminant. This may include, for example, using a first set of RGB pixel values to display a given image under a first illuminant, and a second set of RGB pixel values to display the same image under a second illuminant. The first and second illuminants may have the same intensity but may have slightly different color characteristics, which would be detected by sensor 42 and accounted for in step 308.

If it is determined in step 304 that the ambient light level exceeds a given threshold (e.g., illuminance value L2 of FIG. 8), display control circuitry 30 may set display 14 in bright light mode and processing may proceed to step 310.

At step 310, display control circuitry 30 may adjust display light to maximize readability by increasing the contrast and brightness of images on display 14.

The foregoing is merely illustrative of the principles of this invention and various modifications can be made by those skilled in the art without departing from the scope and spirit of the invention. The foregoing embodiments may be implemented individually or in any combination.

What is claimed is:

1. A method for operating a display having a white point, comprising:

with a light sensor, determining a color and brightness of ambient light;

with control circuitry, comparing the brightness of ambient light to a threshold brightness;

when the brightness of ambient light is above the threshold brightness, adjusting the white point of the display based on the color of ambient light; and when the brightness of ambient light is below the threshold, adjusting the white point of the display to a predetermined white point by modifying pixel values.

2. The method defined in claim 1 wherein when the brightness of ambient light is above the threshold brightness, the control circuitry adapts the display to changes in the color of ambient light.

3. The method defined in claim 1 wherein the predetermined white point mimics the appearance of an incandescent light source.

4. The method defined in claim 1 wherein the predetermined white point is based on user preferences.

5. The method defined in claim 1 wherein the predetermined white point is based on a time of day.

6. The method defined in claim 1 wherein adjusting the white point of the display to the predetermined white point comprises reducing an amount of blue light emitted from the display.

7. The method defined in claim 1 further comprising:

with the control circuitry, receiving the pixel values; and based on the pixel values and the color and brightness of ambient light, modifying the pixel values.

8. The method defined in claim 7 further comprising:

with the control circuitry, determining a pixel color associated with the pixel values; and determining reflectivity characteristics associated with the pixel color.

9. The method defined in claim 8 wherein modifying the pixel values comprises modifying the pixel values based on the reflectivity characteristics associated with the pixel color.

10. The method defined in claim 1 wherein when the brightness of the ambient light is above the brightness threshold, the control circuitry operates the display in paper mode to match the appearance of colors on paper.

11. The method defined in claim 10 wherein when the brightness of the ambient light is below the threshold brightness, the control circuitry operates the display in low light mode without matching the appearance of colors on paper.

12. An electronic device, comprising:

a display having a white point;

a light sensor that measures a color and an intensity of ambient light; and display control circuitry that:

adapts the white point of the display to the color of ambient light when the intensity of ambient light is above a threshold; and adjusts the white point of the display to a predetermined white point value when the intensity of ambient light is below the threshold, wherein the display control circuitry adjusts the white point of the display to the predetermined white point value by modifying blue pixel values to reduce an amount of blue light emitted from the display.

13. The electronic device defined in claim 12 wherein the display control circuitry operates the display in paper mode when the intensity of ambient light is above the threshold such that colors on the display match an appearance of colors on paper.

14. The electronic device defined in claim 13 wherein the control circuitry shifts the display from paper mode to low light mode when the intensity of ambient light drops from above the threshold to below the threshold.

15. The electronic device defined in claim 14 wherein the predetermined white point value of the display in low light mode is more red than the white point of the display in paper mode.

16. An electronic device, comprising:

a color-sensitive ambient light sensor that measures a color and brightness of ambient light;

a display having a white point; and control circuitry that operates the display in a first mode when the brightness of ambient light is above a threshold and a second mode when the brightness of ambient light is below the threshold, wherein the control circuitry adapts the white point of the display to the color of ambient light when the display is operated in the first mode, wherein the control circuitry adjusts the white point to a predetermined white point value when the display is operated in the second mode by modifying red, green, and blue pixel values in the second mode, and wherein the white point remains set at the predetermined white point value while the brightness of the ambient light is below the threshold.

17. The electronic device defined in claim 16 wherein the predetermined white point value is based on user preferences.

18. The method defined in claim 16 wherein the predetermined white point value is based on a time of day.

19. The method defined in claim 16 wherein the control circuitry reduces an amount of blue light emitted from the display when the display is operated in the second mode.

20. The method defined in claim 16 wherein the control circuitry modifies the red, green, and blue pixel values for the display based on stored reflectivity characteristics associated with colors to be produced by the display.

* * * * *